US007131903B2

(12) United States Patent
Galen et al.

(10) Patent No.: US 7,131,903 B2
(45) Date of Patent: Nov. 7, 2006

(54) SEGMENTED SUPERABRASIVE GRINDING DEVICE

(75) Inventors: Edward E. Galen, Akron, OH (US); Donald R. Schlie, Roscoe, IL (US)

(73) Assignee: Cinetic Landis Grinding Corp., Waynesboro, PA (US)

( * ) Notice: Subject to any disclaimer, the term of this patent is extended or adjusted under 35 U.S.C. 154(b) by 0 days.

(21) Appl. No.: 10/523,232

(22) PCT Filed: Jul. 29, 2003

(86) PCT No.: PCT/US03/23517

§ 371 (c)(1),
(2), (4) Date: Jan. 27, 2005

(87) PCT Pub. No.: WO2004/011020

PCT Pub. Date: Feb. 5, 2004

(65) Prior Publication Data

US 2005/0181715 A1 Aug. 18, 2005

(51) Int. Cl.
*B24D 3/00* (2006.01)
*B24D 7/00* (2006.01)
*B24B 33/04* (2006.01)

(52) U.S. Cl. ..... 451/540; 451/542; 451/548

(58) Field of Classification Search ..... 451/540–548, 451/550, 526–534; 51/295, 307, 298
See application file for complete search history.

(56) References Cited

U.S. PATENT DOCUMENTS

| | | | | |
|---|---|---|---|---|
| 4,505,720 | A * | 3/1985 | Gabor et al. | 51/295 |
| 4,671,021 | A | 6/1987 | Takahashi et al. | |
| 5,049,165 | A * | 9/1991 | Tselesin | 51/295 |
| 5,654,078 | A * | 8/1997 | Ferronato | 451/527 |
| 5,989,114 | A * | 11/1999 | Donahue et al. | 451/548 |
| 6,196,911 | B1 * | 3/2001 | Preston et al. | 451/548 |
| 6,394,888 | B1 * | 5/2002 | Matsumoto et al. | 451/548 |
| 6,609,963 | B1 * | 8/2003 | Li et al. | 451/541 |
| 6,755,729 | B1 * | 6/2004 | Ramanath et al. | 451/541 |

* cited by examiner

*Primary Examiner*—Hadi Shakeri
(74) *Attorney, Agent, or Firm*—Reising, Ethington, Barnes, Kisselle, P.C.

(57) ABSTRACT

The present invention is for a grinding device, such as a surface grinding disc or an annular grinding wheel, constructed from a plurality of abrasive segments arranged in an array thereon, wherein the plurality of abrasive segments are embedded in a matrix composition, and wherein the device is abapted to perform a "dry machining" operation. The abrasive segments may be resin bonded or vitrified and may include diamond or other superhard or superabrasive particles, such as, for example, cubic boron nitride ("cBN"), dispersed therein. Both the abrasive segments and the matrix composition include a dry lubricant, such as hexagonal boron nitride, molybdenum disulfide or graphite, dispersed therein. The abrasive segments further include a melt phase metal composition, such as bronze or other copper alloys, to aid in heat dissipation.

29 Claims, 2 Drawing Sheets

SEGMENTED SUPERABRASIVE GRINDING DEVICE

BACKGROUND OF THE INVENTION

The present invention relates to grinding devices, such as grinding discs and wheels. More particularly, the present invention relates to grinding devices, such as grinding discs and wheels, wherein the grinding device is adapted to perform "dry machining" operations.

In the machining of substantially planar workpieces, such as brake rotors, power steering pump rings and rotors, valve plates, coil spring ends, and the like, it is known to pass the workpiece along the radial "face" surface of a surface grinding disc. For example, U.S. Pat. No. 6,419,564 to Herrman, et al., teaches a surface grinding machine and a surface grinding disc used therewith to machine substantially flat workpieces. In particular, Herrman '564 teaches a segmented grinding disc constructed from a circular base to which a plurality of abrasive pieces are secured in a predefined array. The abrasive pieces are arranged so as to define spaces therebetween for the purpose of allowing cooling fluids to flow over, around, in between and away from the abrasive pieces, thereby flushing swarf from the abrasive pieces and facilitating heat dissipation. According to one aspect of the present invention, it is desirable to provide a grinding device, such as, for example, a surface grinding disc or an annular grinding wheel, wherein the device includes a plurality of abrasive segments arranged in an array thereon (or therearound, as the case may be).

Herrman '564 also teaches that the abrasive pieces may include diamond or superabrasive particles, such as cubic boron nitride ("cBN") dispersed therein for reasons which are obvious to those of ordinary skill in the art However, it is customary for machining operations being performed with such a superabrasive grinding device to require a flow of coolant to be directed thereover, as described in Herrman '564, for the purposes discussed therein. For reasons that will be obvious to one of ordinary skill in the art, such "wet machining" operations are undesirable. It is desirable, therefore, to provide a grinding device, such as, for example, a surface grinding disc or an annular grinding wheel, constructed from a plurality of abrasive segments arranged in an array thereon, wherein the abrasive segments include superabrasive particles dispersed therein, and wherein the device is adapted to operate in a "dry machining" environment, that is, for example, without the use of more than a nominal quantity of coolant or other lubricant.

The efficiency of conventional dry machining operations is limited by the rate at which workpiece material may be removed therefrom without imparting workpiece failure or damage, such as, for example, burning. This is because coolants serve an important function of dissipating heat and dry machining is—by definition—machining in a dry or near-dry environment (i.e., without the use of coolants). It is desirable therefore to provide a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

It is desirable furthermore to provide a method of dry machining workpieces wherein the method provides a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

It is also desirable to provide a method of dry machining workpieces with increased machining efficiency, that is, for example, by increasing workpiece material removal rates.

It is even furthermore desirable to provide a method of dry machining workpieces constructed from hard materials, which typically are difficult to dry machine using known dry machining methods and devices.

SUMMARY OF THE INVENTION

The present invention is for a grinding device, such as a surface grinding disc or an annular grinding wheel, constructed from a plurality of abrasive segments arranged in an array thereon, wherein the plurality of abrasive segments are embedded in a matrix composition, and wherein the device is adapted to perform a "dry machining" operation. The abrasive segments may be resin bonded or vitrified and may include diamond or other superhard or superabrasive particles, such as, for example, cubic boron nitride ("cBN"), dispersed therein. Both the abrasive segments and the matrix composition include a dry lubricant, such as hexagonal boron nitride, molybdenum disulphide or graphite, dispersed therein. The abrasive segments further include a melt phase metal composition, such as bronze or other copper alloys, to aid in heat dissipation.

It is an object of the present invention to provide a grinding device, such as, for example, a surface grinding disc or an annular grinding wheel, wherein the device includes a plurality of abrasive segments arranged in an array thereon (or therearound, as the case may be).

It is another object of the present invention to provide a grinding device, such as, for example, a surface grinding disc or an annular grinding wheel, constructed from a plurality of abrasive segments arranged in an array thereon, wherein the abrasive segments include superabrasive particles dispersed therein, and wherein the device is adapted to perform "dry machining" operations, that is, machining operations without the use of more than a nominal quantity of coolant or other lubricant.

It is still another object of the present invention to provide a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

It is yet another object of the present invention to provide a method of dry machining workpieces wherein the method provides a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

It is also an object of the present invention to provide a method of dry machining workpieces with increased machining efficiency, that is, for example, by increasing workpiece material removal rates.

It is still another object of the present invention to provide a method of dry machining workpieces constructed from hard materials, which typically are difficult to dry machine using known dry machining methods and devices.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

The present invention is for a grinding device, such as a surface grinding disc or an annular grinding wheel, constructed from a plurality of abrasive segments arranged in an array thereon, wherein the plurality of abrasive segments are embedded in a matrix composition, and wherein the device is adapted to operate in a "dry machining" or "near-dry machining" environment.

Figure 1:
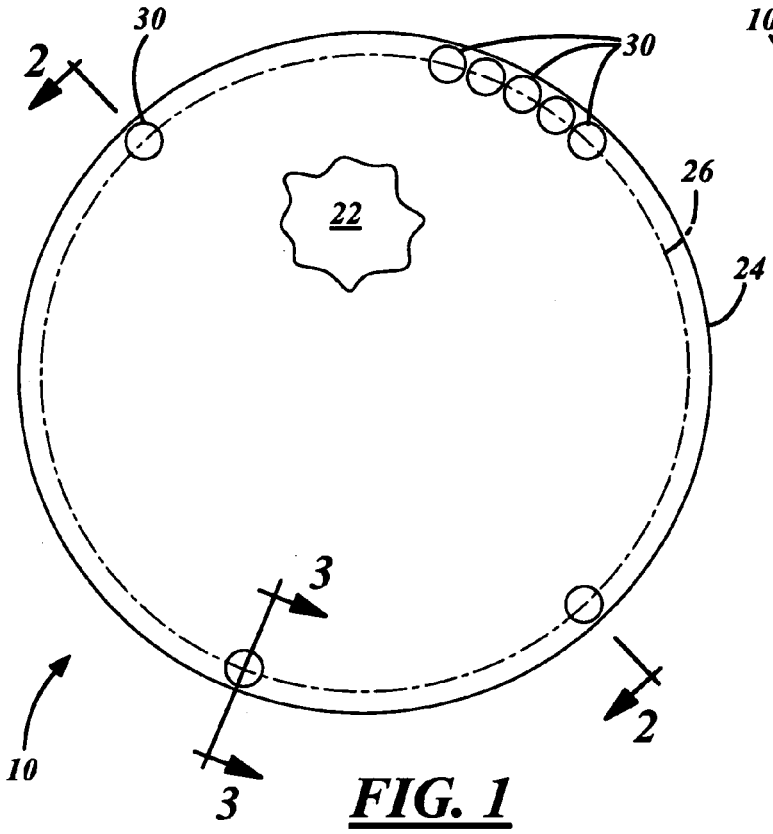
FIG. 1 is a face view of a grinding device according to a preferred embodiment of the present invention.
Figure 2:
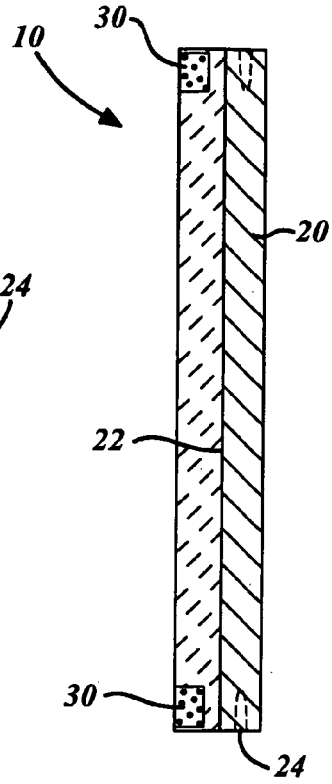
FIG. 2 is an edge section view of the grinding device of FIG. 1, shown along section line 2—2 of FIG. 1.
Figure 3:
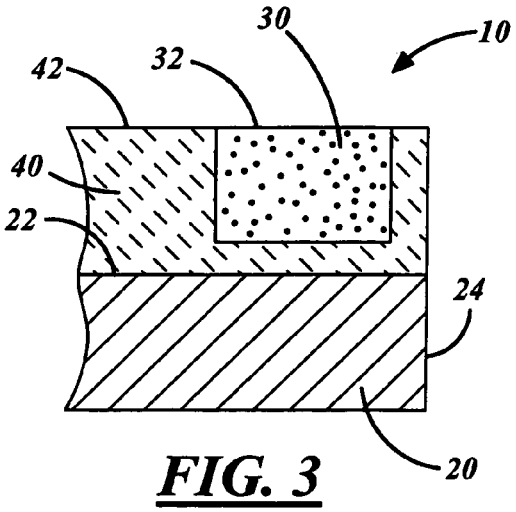
FIG. 3 is a partial section view of the grinding device of FIG. 1, shown along section line 3—3 of FIG. 1.

With reference to FIGS. 1–3, a grinding device 10 according to a preferred embodiment of the present invention takes the form of a surface grinding disc suitable for machining substantially flat workpieces, such as, for example, brake rotors, power steering pump rings and rotors, valve plates, coil spring ends, and the like. The device 10 includes a circular rigid base 20, constructed from, for example, aluminum or steel, one or more abrasive segments 30 (sometimes referred to as "buttons") secured within a matrix composition 40 which is generally circular in shape and conterminous with the base 20. Segments 30 can be viewed as being "embedded" in the matrix composition 40 and may be integrally formed therein or may be inserted into pockets (not shown) formed into the matrix 40 after the matrix has been secured to the base 20. Segments 30 are shown to have a thickness, which is for the purpose of illustration only. Matrix 40 preferably extends to the periphery 24 of the base 20, although it may extend over only a portion over the base 20 towards the periphery 24 thereof. In either case, matrix 40 covers enough of the base 20 and surrounds each of the segments 30 sufficiently to retain segments 30 thereby. Although segments 30 are shown in FIG. 1 arranged in a circular array forming an array path 26 concentric with the device 10, segments 30 may, alternatively, be arranged in some other array.

Figure 4:
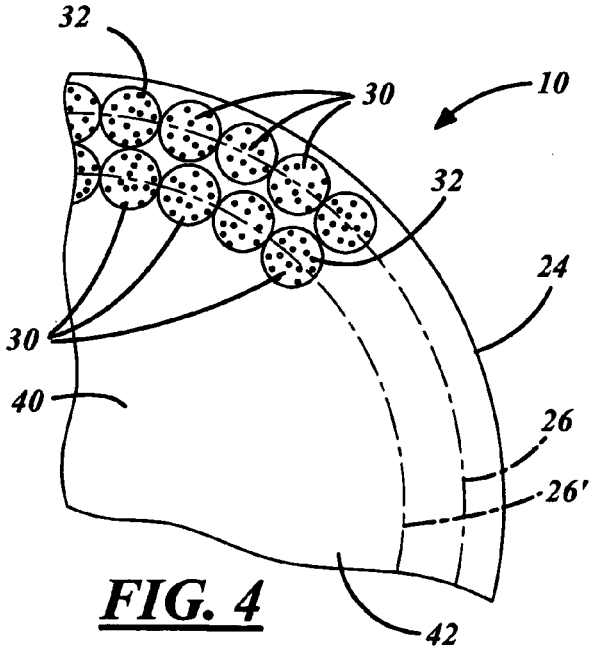
FIG. 4 is a partial face view of a grinding device according to an alternative embodiment of the present invention showing an alternative arrangement of abrasive segments on the device.
Figure 6:
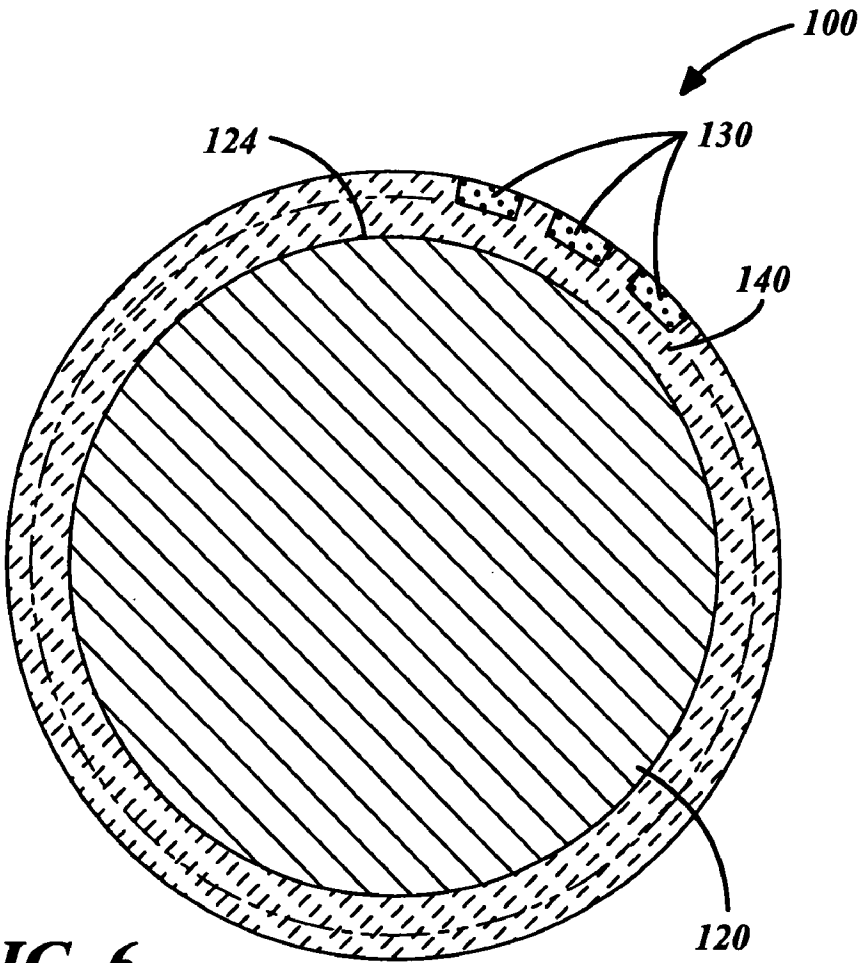

For example, referring to FIG. 4, a portion of the device is shown wherein segments 30 are depicted to be arranged along two concentric paths 26, 26' in abutting relation to one another. Any number of paths, concentric or non-concentric, may be provided without departing from either the spirit or the scope of the present invention. Moreover, segments 30 may be spaced from one another, thereby providing additional matrix composition 40 therebetween It should be pointed out that the present invention is not limited to any particular size, shape or arrangement of segments 30. Thus, non-circular segments, for example, may be used according to the present invention and not depart from either the spirit or the scope thereof. Similarly, not all segments 30 provided on a grinding device 10 need to possess the same size, shape or arrangement as any other segment 30 provided on that device 10. For example, a device 10 may include circular segments 30 in one region thereof and triangular, rectangular, hexagonal or arcuate segments in another region thereof.

Even further, segments 30 need not be provided near the periphery 24 of the device 10, as shown and depicted in the Figures. For the purpose of illustration, however, segments 30 are circular in shape and have a diameter between ¼ in. and 1½ in. Each segment 30 is spaced from adjacent segments 30 by a distance no greater than ½ of the shortest dimension of the workpiece to be machined thereby.

Referring back to FIG. 3, the matrix 40 is formed so that an exposed surface 42 thereof is substantially coplanar with an abrasive face 32 of the segments 30, thereby defining a substantially continuous planar face of the device 10. Using conventional means, workpieces (not shown) are brought into contact with the face of the device and advanced therealong to machine a substantially flat surface of or into the workpiece.

Turning now to the composition of the segments 30, the following compositions and ranges thereof are provided for the purpose of illustration only. Generally stated, according to one aspect of the present invention, a grinding device is provided having abrasive segments comprising: 1) a superabrasive material, such as cBN; 2) a resin bond, such as a polyimide resin; 3) a refractory, non-grinding abrasive grain, such as boron carbide ("BC"); 4) a heat-dissipative melt-phase metal, such as a copper-tin (i.e., bronze) alloy; and, 5) a dry lubricant, such as hexagonal boron nitride ("hBN").

The cBN is provided in an amount ranging between 10% and 43.75% (by volume), and preferably 12% (by volume). Alternatively, diamond may be provided in accordance with the foregoing range.

The cBN is dispersed in a resin bond, preferably a polyimide resin, constituting between 30% and 50% (by volume), and preferably 37.8% (by volume), of the segment (excluding the volume percentage of cBN constituting the segment). A glass frit, such as, for example, borosilicate glass, may be substituted for the resin bond.

The refractory, non-grinding abrasive grain, such as, for example, BC, is provided in an amount less than or equal to 10% (by volume), and preferably 2.2% (by volume), of the segment (excluding the volume percentage of the cBN constituting the segment). BC grain size is preferably less than or equal to ½ the grain size of the average cBN grain, and may be anywhere in the range between 220 and 1000 mesh.

The melt-phase metal may be selected from the class of copper-tin alloys known as bronze, and constitute between 30% and 68% (by volume, excluding the volume percentage of cBN constituting the segment). Preferably, the melt-phase metal is composed of 34.3% (of the segment, by volume) of copper powder and 9.2% (of the segment, by volume) of tin powder. The melt-phase metal serves to enhance heat dissipation through the segment during machining operations.

The dry lubricant is provided to inhibit the generation of heat due to friction and constitutes at least 1% (by volume), and preferably 2.2% (by volume), of the segment (excluding the volume percentage of cBN constituting the segment).

The dry lubricant is preferably formed from hBN, but it may alternatively be formed from molybdenum disulphide, graphite, coke or any lithium sterate.

Turning now to the composition of the matrix 40, the following compositions and ranges thereof are provided for the purpose of illustration only. Generally stated, according to one aspect of the present invention, a grinding device is provided having a matrix surrounding one or more abrasive segments, wherein the matrix comprises: 1) an epoxy resin; 2) a dry lubricant, such as molybdenum disulphide ("MOS"); 3) a porosity filler material, such as a ceramic material shaped into spheroids; and, 4) a refractory non-grinding abrasive grain, such as silicon carbide ("SiC").

The epoxy resin is preferably a two part epoxy with reactive dilutant and anti-foam additives, such as, for example, a two-part epoxy distributed by The Dow Chemical Company or Midland, Mich., identified by Dow product number 331/37-614. Preferably, the matrix comprises 35% (by weight) of the epoxy resin.

The dry lubricant is preferably MOS provided in an amount ranging between 1% and 5% (by weight), and preferably 1.7% (by weight). Similar to the dry lubricant provided in the segments, the dry lubricant is provide in the matrix for the purpose of inhibiting the generation of heat due to friction.

The porosity filler material is provided in an amount ranging between 3% and 15% (by weight), and preferably 7.0% (by weight). Preferably, the filler is a 14/40 ceramic bubble material.

The refractory material is provided for the purpose of wear retardation, and is composed of an abrasive grain such as AlO3, SiC, boron carbide or zirconium oxide in an amount ranging between 10% and 70% (by weight), and preferably 56.3% (by weight). The grain size of the refractory material preferably is the same size or smaller than the grain size of the cBN used in the segments.

Referring now back to FIGS. 1–3, one method for constructing the grinding device 10 according to the preferred embodiment of the present invention will now be described.

A grinding device according to the present invention provides many features, benefits and advantages, including without limitation: improving safety of operation during high-speed grinding, increasing wheel "life", increasing finish quality, reducing wheel dust, eliminating wheel dressing requirements and improving metallurgical integrity of the workpiece (i.e., no more than % negligible burns, stresses or other subsurface workpiece damage).

Figure 5:
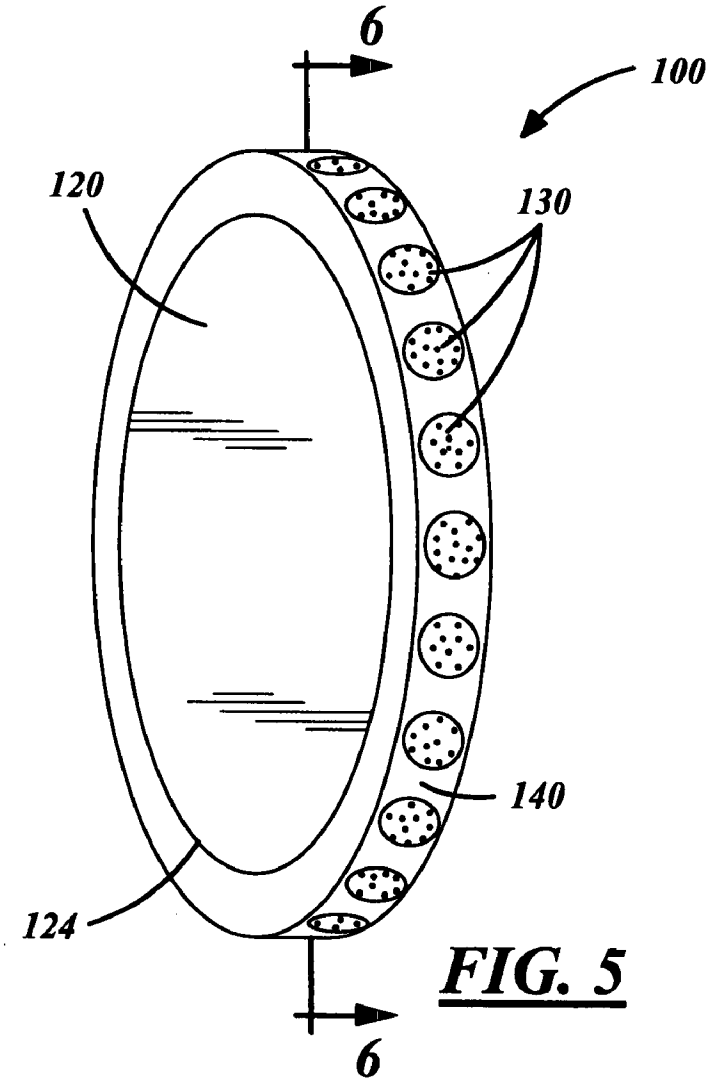
FIG. 5 is a face view of a grinding device according to an alternative embodiment of the present invention; and, FIG. 6 is a section view of the grinding device of FIG. 5, shown along section line 6—6 of FIG. 5.

Referring now to FIG. 5, a device 100 according to one alternative embodiment of the present invention takes the form of an annular grinding wheel suitable for cylindrical machining operations to machine generally cylindrical workpieces, such as, for example, crankshaft bearings and pins, camshaft lobes, and the like. Device 100 includes a cylindrical base 120, constructed from, for example, aluminum or steel, one or more abrasive segments 130 secured within an annular matrix composition 140 which at least partially surrounds an outer peripheral surface 124 of the base 120. Segments 130 can be viewed as being "embedded" in the matrix 140 and may be integrally formed therein or may be inserted into pockets (not shown) formed into the matrix 140 after the matrix 140 has been formed around (or otherwise secured to) the base 120. Segments 130 are shown to have a thickness, which is for the purpose of illustration only. Matrix 140 is shown to cover the entire peripheral surface 124 of the base, although it may alternatively cover only a portion thereof. In either case, matrix 140 covers enough of the base 120 and is of a sufficient thickness to surround each of the segments 130 to prevent dislodging of the segments 130 during use.

Although the segments 130 are shown in spaced relation over only a portion of the periphery of the device 100, segments 130 may be spaced around the entire periphery. Moreover, although segments 130 are shown depicted as circular "buttons", they may alternatively take the form of arcuate segments (not shown), whether spaced from one another by a nominal distance or in an end-to-end abutting relation.

The composition of the segments 130 and of the matrix 140 according to the present embodiment is the same as the composition of the segments 30 and of the matrix 40, respectively, of the preferred embodiment hereof.

Devices 30, 130 according to the present invention are suitable for performing dry machining operations on hard workpieces at feed rates in excess of 40 meters/second. Indeed, it has been observed that the device 30 according to the preferred embodiment hereof provides optimal dry machining operations at a feed rate of about 50 meters/second.

The present invention provides a grinding device, such as, for example, a surface grinding disc or an annular grinding wheel, wherein the device includes a plurality of abrasive segments arranged in an array thereon (or therearound, as the case may be).

The present invention also provides a grinding device, such as, for example, a surface grinding disc or an annular grinding wheel, constructed from a plurality of abrasive segments arranged in an array thereon, wherein the abrasive segments include superabrasive particles dispersed therein, and wherein the device is adapted to perform "dry machining" operations, that is, machining operations without the use of more than a nominal quantity of coolant or other lubricant.

The present invention even further provides a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

Even more, the present invention provides a method of dry machining workpieces wherein the method provides a grinding device, such as, for example, a surface grinding disc or an annular grinding wheel, constructed from a plurality of abrasive segments arranged in an array thereon, wherein the plurality of abrasive segments are embedded in a matrix composition adapted to enhance heat dissipation.

The present invention also provides a method of dry machining workpieces with increased machining efficiency, that is, for example, by increasing workpiece material removal rates.

The present invention even further provides a method of dry machining workpieces constructed from hard materials, which typically are difficult to dry machine using known dry machining methods and devices.

Despite being adapted to perform "dry machining" operations, a grinding device according to the present invention will operate without any loss of function or benefit in a "wet machining" environment and the examples used herein should not be interpreted as limiting the scope of the present invention to only "dry machining" operations or machining environments.

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

We claim:

1. A grinding device especially adapted to perform dry machining, the grinding device comprising:

a plurality of grinding segments and a matrix surrounding at least one of said plurality of grinding segments, said at least one of said plurality of grinding segments comprising a resin bond material and a superabrasive material provided in an amount between 10% and 43.75% by volume of the total composition of the grinding segment dispersed throughout the resin bond material, said at least one grinding segment comprising a refractory non-grinding abrasive grain material provided in an amount less than 10% by volume of the total composition of the grinding segment, a heat-dissipative melt-phase metal material comprising a copper tin alloy provided in an amount between 30% and 68% by volume of the total composition of the grinding segment to enhance heat dissipation through the grinding segments, and a dry lubricant material provided in an amount at least 1% by volume of the total composition of the grinding segment to inhibit the generation of heat due to friction; and said matrix comprising an epoxy resin, said matrix further comprising a dry lubricant provided in an amount between 1% and 5% by weight of the total composition of the matrix to inhibit the generation of heat due to friction, a porosity filler provided in an amount between 3% and 15% by weight of the total composition of the matrix, and a refractory non-grinding abrasive grain provided in an amount between 10% and 70% by weight of the total composition of the matrix for the purpose of wear retardation, whereby the grinding device is adapted to perform dry machining operations without the use of more than a nominal quantity of coolant or other lubricant.

2. The grinding device of claim 1, wherein said superabrasive material of said grinding segment is diamond.

3. The grinding device of claim 1, wherein said superabrasive material of said grinding segment is cubic boron nitride.

4. The grinding device of claim 1, wherein said superabrasive material of said grinding segment is provided in an amount of 12% (by volume) of the total composition of the grinding segment.

5. The grinding device of claim 1, wherein said refractory material of said grinding segment is boron carbide.

6. The grinding device of claim 1, wherein said refractory material of said grinding segment is provided in an amount of 2.2% of the total composition of the grinding segment.

7. The grinding device of claim 1, wherein a grain size of the refractory material of said grinding segment is less than or equal to a grain size of superabrasive material.

8. The grinding device of claim 1, wherein a grain size of the refractory material of said grinding segment is between 220 mesh and 1000 mesh.

9. The grinding device of claim 1, wherein the melt-phase material of said grinding segment is bronze.

10. The grinding device of claim 1, wherein the melt-phase material of said grinding segment is provided in an amount of 34.3% of the total composition of the grinding segment.

11. The grinding device of claim 1, wherein the dry lubricant of said grinding segment is hexagonal boron nitride.

12. The grinding device of claim 1, wherein the dry lubricant of said grinding segment is molybdenum disulphide.

13. The grinding device of claim 1, wherein the dry lubricant of said grinding segment is graphite.

14. The grinding device of claim 1, wherein the dry lubricant of said grinding segment is coke.

15. The grinding device of claim 1, wherein the dry lubricant of said grinding segment is a lithium sterate.

16. The grinding device of claim 1, wherein the dry lubricant of said grinding segment is provided in an amount of 2.2% (by volume) of the total composition of the grinding segment.

17. The grinding device of claim 1, wherein said resin bond material of said grinding segment is a polyimide resin.

18. The grinding device of claim 1, wherein said dry lubricant of said matrix is molybdenum disulphide.

19. The grinding device of claim 1, wherein said dry lubricant of said matrix is provided in an amount of 1.7% (by weight) of the total composition of the matrix.

20. The grinding device of claim 1, wherein said porosity filler of said matrix is a ceramic material shaped into spheroids.

21. The grinding device of claim 20, wherein said porosity filler of said matrix is a 14/40 ceramic bubble material.

22. The grinding device of claim 1, wherein said porosity filler of said matrix is provided in an amount of 7% (by weight) of the total composition of the matrix.

23. The grinding device of claim 1, wherein said refractory material of said matrix is aluminum oxide.

24. The grinding device of claim 1, wherein said refractory material of said matrix is silicon carbide.

25. The grinding device of claim 1, wherein said refractory material of said matrix is boron carbide.

26. The grinding device of claim 1, wherein said refractory material of said matrix is zirconium carbide.

27. The grinding device of claim 1, wherein said refractory material of said matrix is provided in an amount of 56.3% (by weight) of the total composition of the matrix.

28. The grinding device of claim 1, wherein a grain size of the refractory material of the matrix is equal to or smaller than a grain size of the superabrasive material of the grinding segment.

29. The grinding device of claim 1, wherein the epoxy resin is a two-part epoxy with reactive dilutant and anti-foam additives.

* * * * *